US007371084B2

(12) United States Patent
Xue et al.

(10) Patent No.: US 7,371,084 B2
(45) Date of Patent: May 13, 2008

(54) AUDIO JACK CONNECTOR WITH RELIABLE GROUNDING DEVICE

(75) Inventors: Zhang-Lan Xue, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/528,197

(22) Filed: Sep. 27, 2006

(65) Prior Publication Data

US 2007/0072488 A1 Mar. 29, 2007

(30) Foreign Application Priority Data

Sep. 28, 2005 (CN) ..... 2005 2 0076108 U

(51) Int. Cl.
*H01R 13/648* (2006.01)

(52) U.S. Cl. ..... 439/95; 439/108; 439/668; 439/939

(58) Field of Classification Search ..... 439/95, 439/108, 101, 668, 607, 939
See application file for complete search history.

(56) References Cited

U.S. PATENT DOCUMENTS 6,312,267 B1 * 11/2001 Wang ..... 439/92

* cited by examiner

*Primary Examiner*—Ross Gushi
(74) *Attorney, Agent, or Firm*—Wei Te Chung

(57) ABSTRACT

An audio jack connector (100) with reliable grounding device includes a dielectric housing (1) defining an inner receiving space (12) and a grounding member (2) mounted on the housing (1). The grounding member (2) includes a base portion (21) secured on the housing, a mating portion (242) extending into the inner receiving space (12), a terminal portion (25) for inserting into a print circuit board (6) and a spring portion (26) extending beyond the housing for connecting to a metallic panel (5) of an electrical device. This grounding structure combines inner and outer grounding together by an integrated grounding piece, which enhance the grounding effect.

20 Claims, 7 Drawing Sheets

AUDIO JACK CONNECTOR WITH RELIABLE GROUNDING DEVICE

BACKGROUND OF THE INVENTION

1. Field of the Invention

The present invention relates to an electrical connector, and especially to an audio jack connector having a reliable grounding device.

2. Description of Related Art

Audio connectors are usually used in computer or other electronic equipment for transferring audio signals. An audio connector may include an audio plug and an audio jack.

A conventional audio jack is disclosed in U.S. Pat. No. 6,312,267. The audio jack has a housing 1 including an embedded groove 13 positioned at the bottom near the front surface, and a retaining groove 16 formed at the bottom of the housing 1. The audio jack further comprises a grounding piece 10 for abating the interfering effect of noise from outside and a L-shaped grounding terminal 15 for inner grounding. One end of the ground piece 10 is bent as an L-shaped insert end 11 for being inserted into an embedded groove 13 of the dielectric housing 1 for preventing the grounding piece 10 from sliding. The main body of the grounding piece and the inserting end 10 are formed as a tilted hook. The main body includes a frame-type grounding portion 12 which extends about the periphery of a round cylinder 14 formed on the front surface of the housing 1.

A further grounding terminal 15 is installed. The grounding terminal comprises a transverse portion and a longitudinal portion. The transverse portion is engaged to the retaining groove 16 of the housing 1. Meanwhile, the front end of the transverse portion extends toward the front surface so as to connect to the grounding piece 10. The longitudinal portion is insert into through hole formed on a PCB connecting the grounding piece 10 to the grounding circuit on the PCB so as to suppress noise form outside.

In this grounding structure, the inner grounding and the exterior grounding are jointed together, which can get better grounding effect. However, it also brings some problems. Firstly, the grounding piece 10 cannot be securely fixed on the housing and requires a space between the panel of electronic device and the audio jack housing to receive it. Further, the connection between the grounding piece and the grounding terminal is not reliable especially when the grounding terminal fails to recover from deflection permanently after mating with an audio plug. In addition, as the grounding terminal is fixed mainly by soldering on the print circuit board, the grounding terminal will come loose after the plug is inserted in and pulled out for a lot of times.

Hence, it's desirable to invent a grounding structure that overcomes the above disadvantages.

SUMMARY OF THE INVENTION

Accordingly, the primary object of the present invention is to provide an audio jack connector combining the inner grounding and exterior grounding together.

Other object of the present invention is to provide an audio jack connector assembly with enhanced grounding performance.

To achieve the above objects, the present invention provides an audio jack connector comprising an dielectric housing having an interior receiving space, a front wall defining a recess, and a plurality of first slots and a second slot each in communication with the receiving space; a plurality of contacts respectively secured in said first slots and extending into said interior receiving space for electrical connecting to said plug; a grounding member secured to said housing having a base portion situated on said recess, a mating portion extending through said second slot and running into said interior receiving space for electrical connecting to said plug, a terminal portion for connecting to a print circuit board on which said audio jack connector mounted, and a spring portion extending beyond said front wall.

To achieve the above objects, the present invention provides an audio jack connector assembly comprising a metallic panel of an electrical device; a plug; a dielectric housing mounted to said metallic panel having an interior receiving space for receiving a portion of said plug, a bottom wall defining a plurality of first slots and a second slot in communication with said receiving space respectively; a plurality of contacts respectively secured in said first slots and extending into said receiving space for electrical connecting to said plug; a grounding member secured to said housing having a base portion mounted on said housing, a mating portion extending through said second slot and running into said interior receiving space for electrical connecting to said plug, a terminal portion extending below said bottom wall for connecting to a print circuit board on which said audio jack connector mounted, and a spring portion extending beyond said housing for electrically connecting with metallic panel of an electrical device.

The various objects and advantages of the present invention will be more readily understood from the following detailed description when read in conjunction with the appended drawings.

BRIEF INSTRUCTION OF THE DRAWINGS

DETAILED DESCRIPTION OF THE INVENTION

Figure 1:
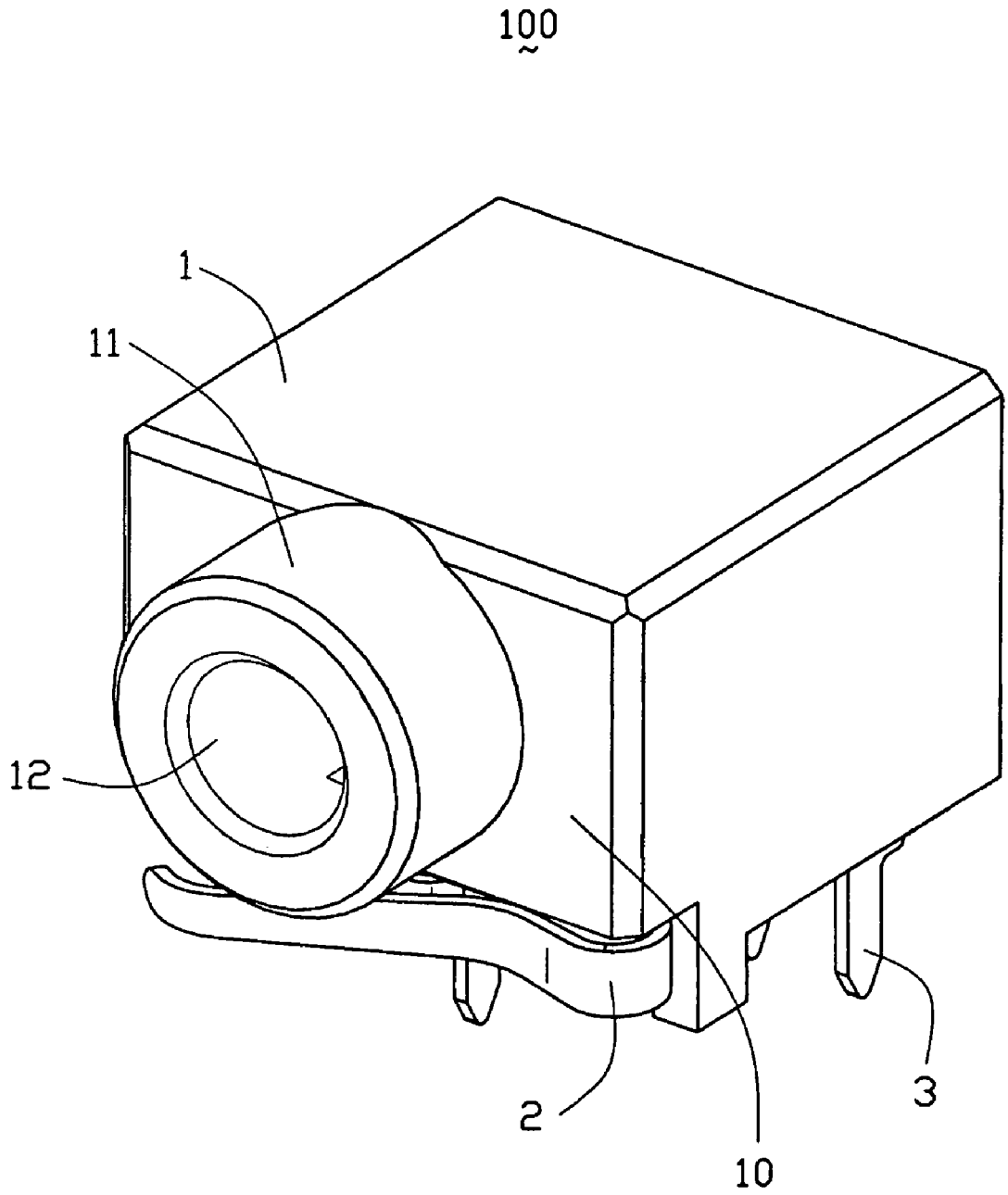
FIG. 1 is a perspective view of an audio jack connector in accordance with the principle of the present invention.

Reference will now be made to the drawing to describe the present invention in detail.

Figure 2:
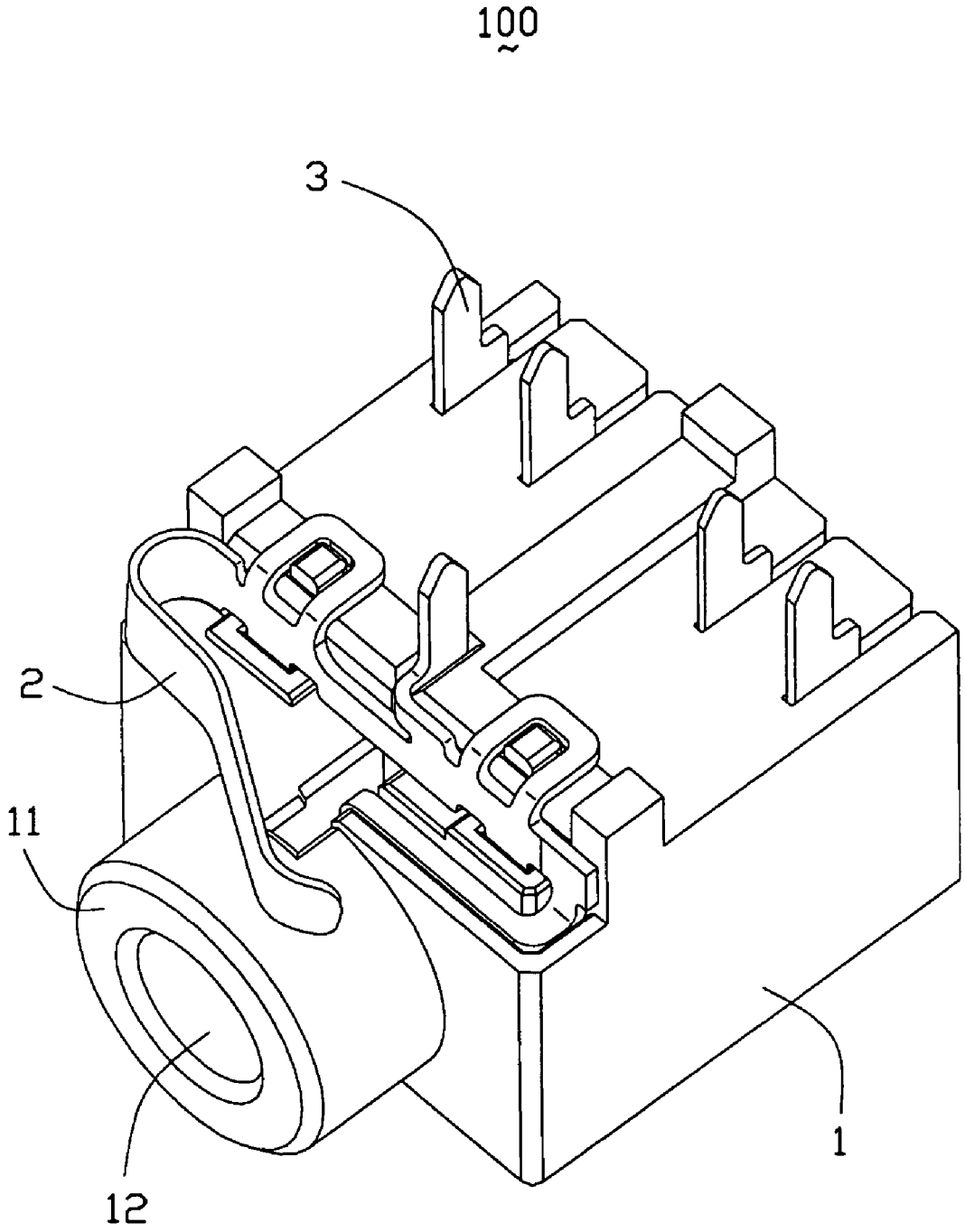
FIG. 2 is another perspective view of the audio jack connector.
Figure 3:
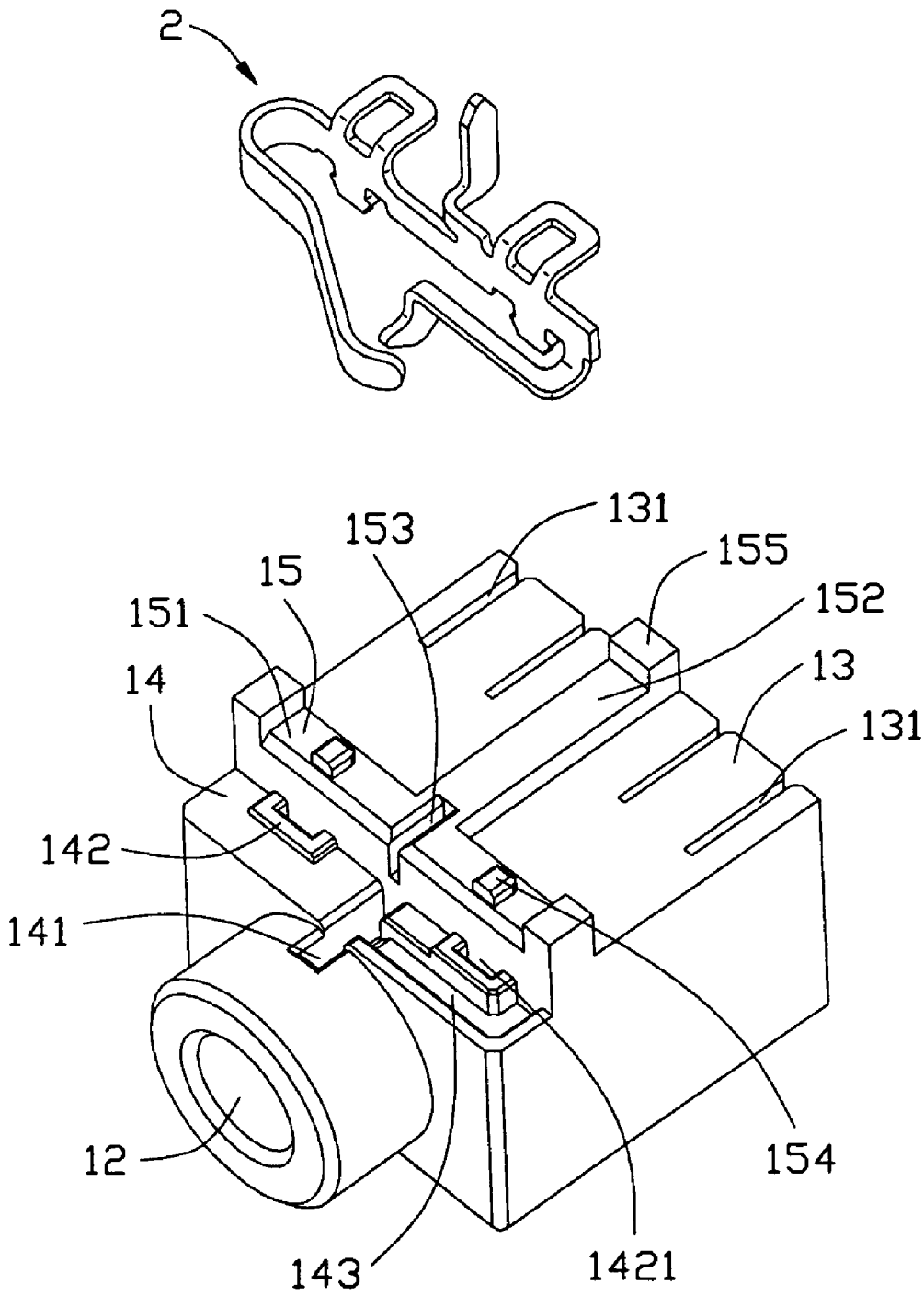
FIG. 3 is a partially exploded perspective view of the audio jack connector in which the grounding member apart from the housing.
Figure 5:
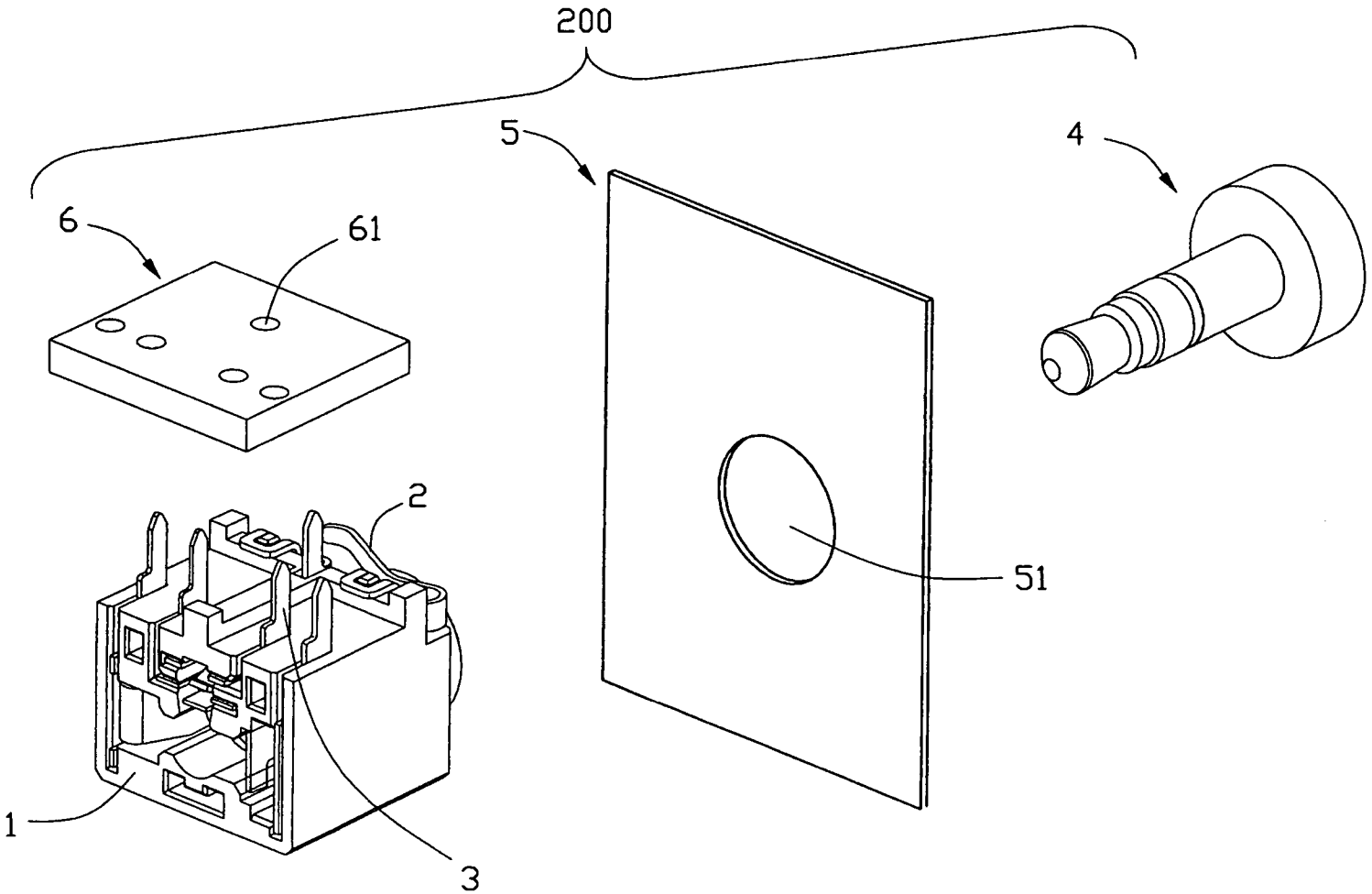
FIG. 5 is an exploded perspective view of an assembly utilizing the audio jack connector shown in FIG. 1 to FIG. 4B.

Referring to FIG. 1 to 3, one embodiment of the audio jack connector 100 with reliable grounding of the present invention is illustrated. In the audio jack connector 100, a round cylinder 11 is formed on the front wall 10 of a dielectric housing 1. The cylinder 11 defines a receiving hole extending into the housing 1 that defines an interior receiving space 12 for receiving a plug 4 as shown in FIG. 5 as is known in this art. A recess 14 is formed at the conjunction section of the front wall 10 and the bottom wall 13 of the housing 1. In the middle section of the recess 14, there forms a slot 141 extending to the cylinder 11, and the slot 141 is in communication with the receiving space 12. Further, a pair of protrusion 142 is formed on the recess 14 locating at two opposite side of the slot 141 and each defines a groove 1421 toward the bottom wall 13. Also, a groove 143 is formed around the right protrusion 142 and runs into the slot 141. In addition, a T-shaped rail 15 is formed on the bottom wall 13 having a level portion 151 in landscape orientation and an upright portion 152 perpendicular to the level portion 151. The level portion 151 defines a blind slot 153 at the joint section of the level portion 151 and the upright portion 152 and two tabs 154 positioned on two opposite side of the slot 153. Three protrusions 155 are respectively formed on the three distal end of the T-shaped rail 15. The audio jack connector 100 further has a plurality of signal contacts 3 respectively secured in a set of slots 131 formed on the bottom wall 13, and the slots 131 are in communication with the receiving space 12.

Figure 4A:
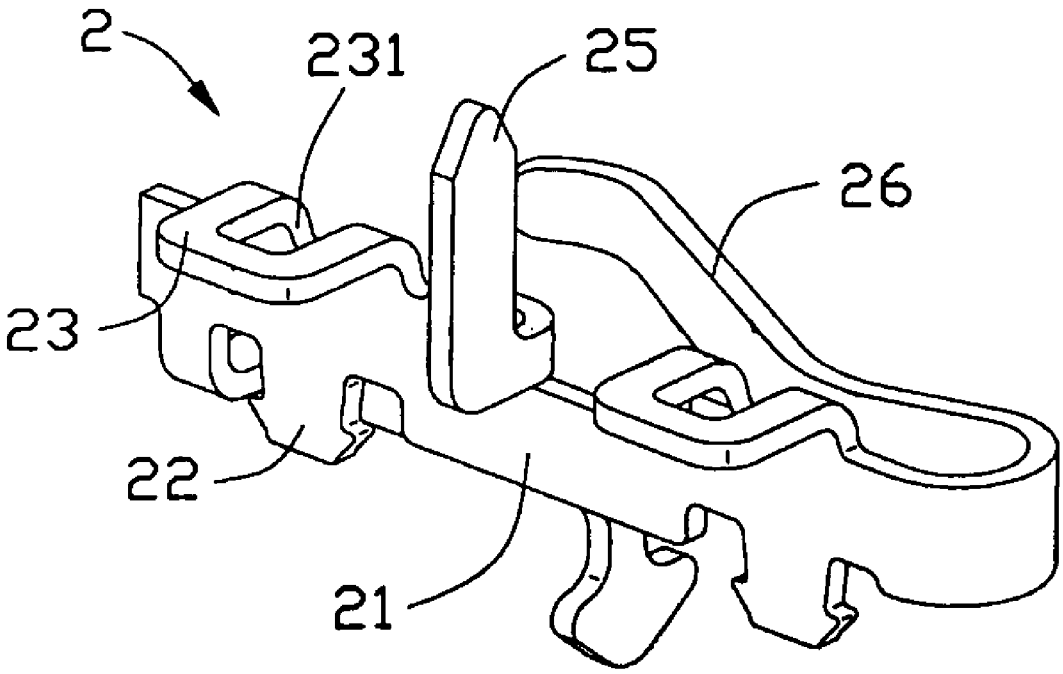
FIG. 4A is a perspective of the grounding member.
Figure 4B:
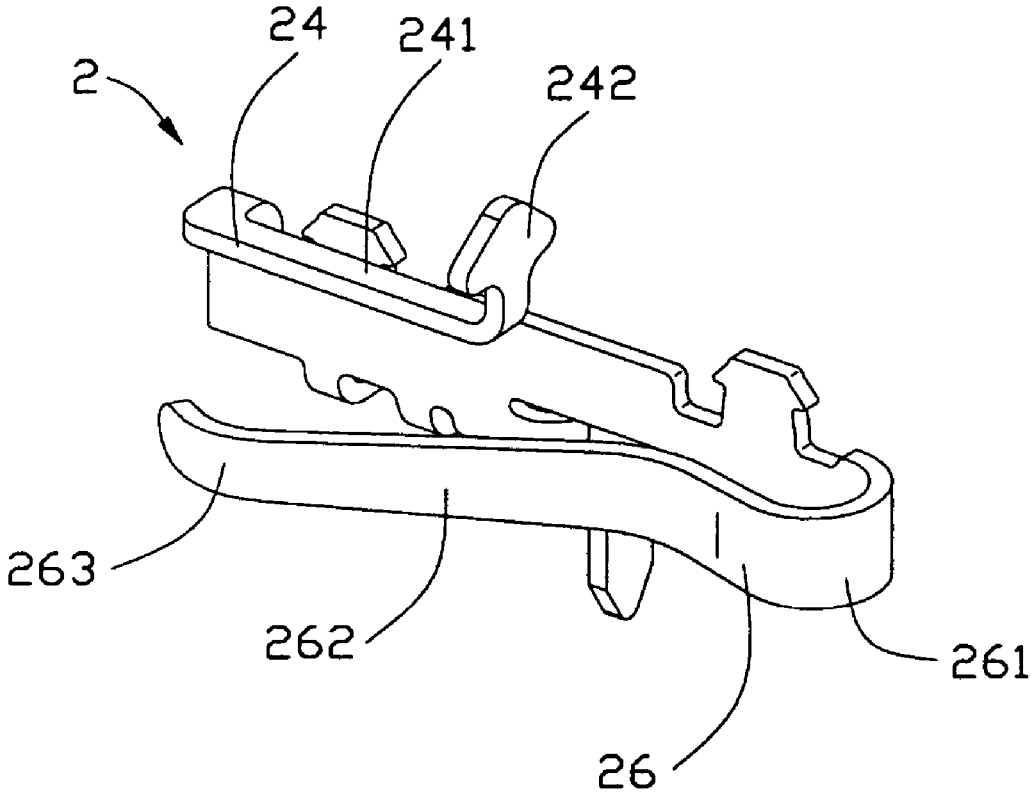
FIG. 4B is another perspective of the grounding member.

With reference to FIGS. 4A and 4B, a grounding piece 2 is made from one metallic piece and has a longitudinal base portion 21 mounted on the recess 14 of the housing 1. A pair of locking finger 22 uprightly formed at the lower edge of the base portion 21 is inserted into the grooves 1421 of protrusions 142. On the opposite edge, a pair of locking portion 23 extends perpendicularly from the base portion 21 each defining an opening 231 in which the tabs 154 of the rail 15 is locked so as to mount the grounding piece 2 to the housing 1. The grounding piece 2 further has a cantilever 24 perpendicularly folded beside one locking finger 22. The cantilever 24 includes a transit portion 241 received at the groove 143 around the protrusion 142 of the housing 1; an upright triangular mating portion 242 received in the slot 141 and extending into the receiving space 12 partially located in said cylinder 11. The mating portion 242 is electrically connected to the plug 4 so as to form the inner grounding. A terminal portion 25 is split from the base portion 31 and located between the locking pieces 33, which are electrically connected with the grounding circuit on the PCB 6 as shown in FIG. 5. The terminal portion 25 is secured at the blind slot 153 of the housing 1. In addition, a spring portion 26 extends from one end of the base portion 21 in the longitudinal direction. The spring portion 26 has a U-shaped transit portion 261 connecting to the base portion 31, a body portion 262 extending outward gradually and an arc shape distal end 263. The distal end 263 extend beyond the recess 14 of the housing 1 electrical connecting to the panel 5 before assembling of the electrical device forming the exterior grounding, and will inflect into the recess 14 when assembling to the electrical device maintaining electrical connection with the panel 5.

Figure 6:
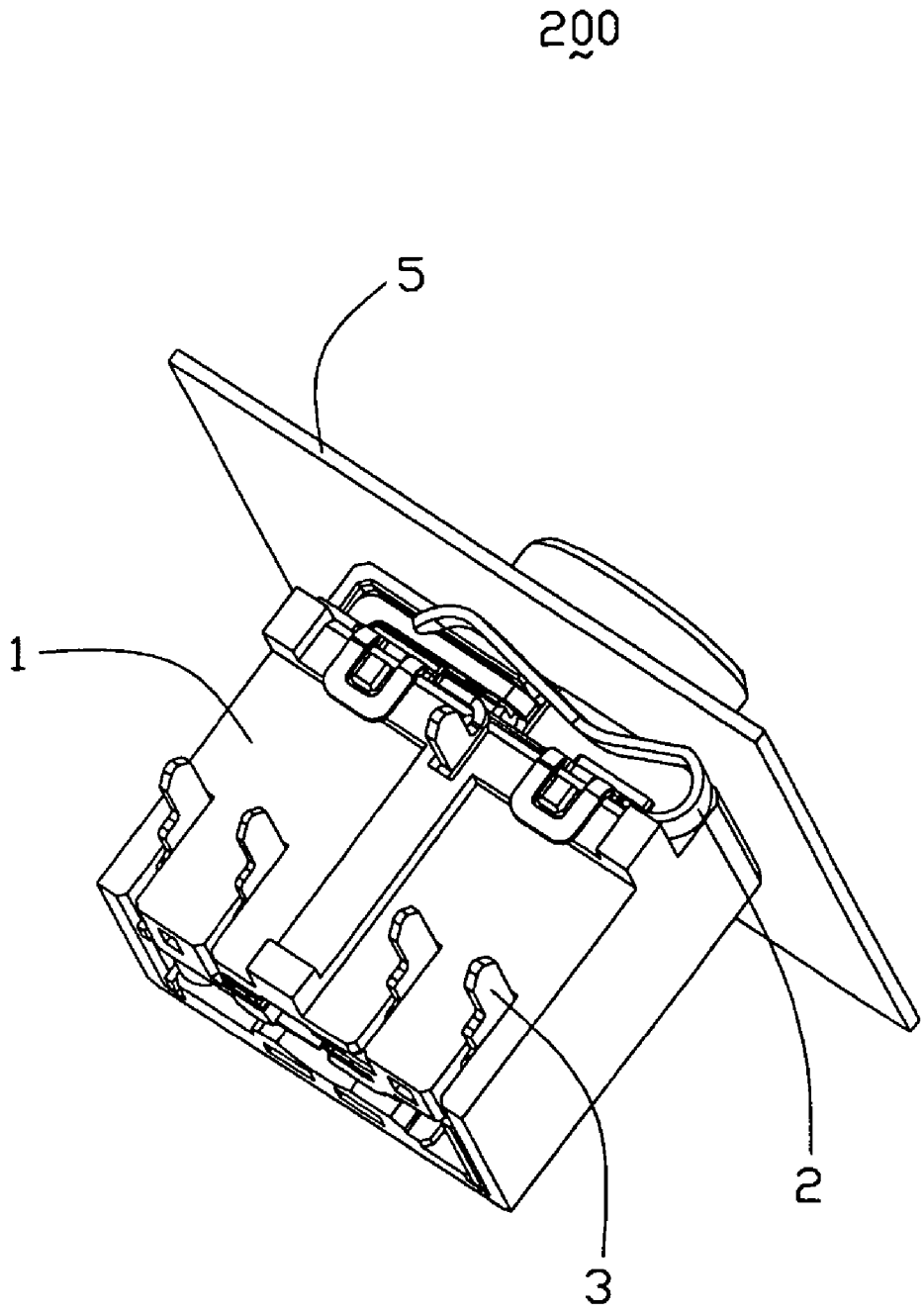
FIG. 6 is unexploded perspective view of the assembly in which the audio jack connector mounted on a panel of an electrical device.

Now with reference to FIGS. 5 and 6, an audio jack assembly 200 is disclosed. Here, a rectangular piece 5 represents a metallic panel 5 of an electrical device, on which a round hole 51 is formed. The distal end 263 of the grounding piece 2 is located below the cylinder 11 and extends beyond the housing 1. When assembling the audio jack connector 100 to the panel 5 of an electrical device, the cylinder 11 is inserted into the hole 51, and the distal end 263 firstly abuts the panel 5 and then inflects into the recess 14. The contact portion 25 and the terminal of signal contacts 3 are mounted into the through hole 61 formed on the PCB 6. A plug 4 has a round pin portion insert into the receiving space 12 electrical connecting to the grounding piece 2 and signal contacts 3. As described above, the audio jack connector 100 provides reliable grounding by combining the inner grounding and the outer grounding through one piece grounding structure, and the grounding piece fixed to the housing firmly. And the grounding piece inflects into the recess and doesn't require a space between the housing 1 and the panel 5 so as to increase the reliability of grounding.

Although the present invention has been described with reference to the preferred embodiments, it will be understood that the invention is not limited to the details thereof. Various substitutions and modifications have been suggested in the foregoing description, and others will occur to those of ordinary skill in the art. Therefore, all such substitutions and modifications are intended to be embrace within the scope of the invention in the appended claims.

What is claimed is:

1. An audio jack connector for mating with a plug connector, comprising:

a dielectric housing having an interior receiving space, a front wall defining a recess, and a plurality of first slots and a second slot each in communication with said interior receiving space;

a plurality of contacts respectively secured in said first slots and extending into said interior receiving space for electrical connection to said plug; and a grounding member secured to said housing and having a base portion situated on said recess, a cantilever extending through said second slot into said interior receiving space for electrical connection to said plug, a terminal portion for connecting to a print circuit board on which said audio jack connector is mounted, and a spring portion extending beyond said front wall.

2. The audio jack connector as claimed in claim 1, wherein said recess is defined in a lower side of said front wall and adjacent to said cylinder portion.

3. The audio jack connector as claimed in claim 1, wherein said recess is defined in an upper side of said front wall and adjacent to said cylinder portion.

4. The audio jack connector as claimed in claim 1, wherein said cantilever extends from one end of said base portion and includes a mating portion.

5. The audio jack connector as claimed in claim 4, wherein said spring portion projects from opposite end of the base portion and has an arc-shaped distal end.

6. The audio jack connector as claim in claim 5, wherein said spring portion runs substantially parallel to said base portion.

7. The audio jack connector as claimed in claim 1, wherein said housing further has a cylinder portion formed on the front wall, and wherein said cylinder portion defines a through hole in communication with said receiving space.

8. The audio jack connector as claimed in claim 7, wherein said cantilever of said grounding member is partially received in said hole of said cylinder portion and compressiblely moves toward outside of said cylinder portion when said plug connector is inserted.

9. The audio jack connector as claimed in claim 1, wherein said grounding member has at least one locking portion projecting perpendicularly from the base portion, and wherein said housing forms at least one protrusion on its bottom wall for locking with said at least one locking portion.

10. The audio jack connector as claimed in claim 9, wherein said grounding member has at least one tab projecting from a side opposite to said at least one locking portion, and wherein said housing has at least one groove formed in said recess for receiving said at least one tab.

11. An electrical system, comprising:

a metallic panel;

a plug;

a print circuit board; and a receptacle mounted on said print circuit board comprising a dielectric housing defining a receiving space receiving said plug, the housing having a front wall confronting said panel and a neck section projecting from the front wall and extending through said panel;

a plurality of contacts received in said housing; and a grounding device detachably secured to said housing and having a mating portion extending partially within the neck section for electrical connection to said plug, a terminal portion extending opposite to said mating portion for connecting to said print circuit board, and a spring portion electrically connecting with said metallic panel.

12. The electrical system as claimed in claim 11, wherein said grounding device includes a base portion from which said mating portion, said terminal portion and said spring portion extend respectively.

13. The electrical system as claimed in claim 12, wherein said housing defines a recess in said front wall for securing the base portion of said grounding device, and wherein said spring portion deflected into said recess when said housing mounted on said metallic panel.

14. The electrical system as claimed in claim 12, wherein said spring portion runs substantially parallel to said base portion and has an arc-shaped distal end.

15. The electrical system as claimed in claim 12, wherein said grounding device has at least one locking portion projecting perpendicularly from the base portion, and wherein said housing forms at least one protrusion on its bottom wall for locking with said at least one locking portion.

16. The electrical system as claimed in claim 15, wherein said grounding device has at least one tab projecting from a side opposite to said at least one locking portion, and wherein said housing has at least one groove formed in said recess for receiving said at least one tab.

17. An electrical connector assembly comprising:

an insulative housing defining a front abutment face for abutting against a panel and a bottom face for mounting to a printed circuit board;

a recess formed around and fully exposed on an intersection of said abutment face and the mounting face;

a metallic grounding device received in the recess; wherein said grounding device includes a resilient arm extending forwardly beyond the abutment face, and mounting leg extending downwardly beyond the mounting face; wherein the resilient arm extends in a horizontal direction so as not to invade a space in front of the front abutment face.

18. The electrical connector assembly as claimed in claim 17, wherein said grounding device includes fastening lance upwardly piercing into a downward slot in the housing, said downward slot being in communication with the recess downwardly.

19. The electrical connector assembly as claimed in claim 17, wherein said grounding device further includes a horizontal locking portion which is essentially sandwiched between the bottom face of the housing and a printed circuit board on which the housing is seated.

20. The electrical connector assembly as claimed in claim 17, wherein said resilient arm and said mounting leg are formed unitarily with said metallic grounding device.

* * * * *